US010043606B2

(12) United States Patent
Sugimoto et al.

(10) Patent No.: US 10,043,606 B2
(45) Date of Patent: Aug. 7, 2018

(54) MAGNETIC MATERIAL AND METHOD FOR PRODUCING MAGNETIC MATERIAL

(71) Applicant: Japan Science and Technology Agency, Kawaguchi-shi, Saitama (JP)

(72) Inventors: Satoshi Sugimoto, Sendai (JP); Keita Isogai, Sendai (JP)

(73) Assignee: Japan Science and Technology Agency, Kawaguchi-shi, Saitama (JP)

( * ) Notice: Subject to any disclaimer, the term of this patent is extended or adjusted under 35 U.S.C. 154(b) by 344 days.

(21) Appl. No.: 14/761,220

(22) PCT Filed: Jan. 7, 2014

(86) PCT No.: PCT/JP2014/050078
§ 371 (c)(1),
(2) Date: Jul. 15, 2015

(87) PCT Pub. No.: WO2014/112406
PCT Pub. Date: Jul. 24, 2014

(65) Prior Publication Data

US 2015/0348684 A1 Dec. 3, 2015

(30) Foreign Application Priority Data

Jan. 16, 2013 (JP) ..... 2013-005507

(51) Int. Cl.
*H01F 1/00* (2006.01)
*H01F 41/02* (2006.01)
(Continued)

(52) U.S. Cl.
CPC ..... *H01F 1/053* (2013.01); *B22F 3/02* (2013.01); *B22F 3/12* (2013.01); *B22F 3/24* (2013.01);
(Continued)

(58) Field of Classification Search
None
See application file for complete search history.

(56) References Cited

U.S. PATENT DOCUMENTS 4,023,991 A * 5/1977 Kubo ..... C22C 28/00 148/120
2009/0004087 A1* 1/2009 Takenaka ..... G02B 1/02 423/324
(Continued)

FOREIGN PATENT DOCUMENTS

CN 101023147 A 8/2007
CN 102320650 A 1/2012
(Continued)

OTHER PUBLICATIONS

English Translation of Zhou et al. (CN article) (Year: 2010).*
(Continued)

*Primary Examiner* — Kevin M Bernatz
(74) *Attorney, Agent, or Firm* — Amster, Rothstein & Ebenstein LLP

(57) ABSTRACT

An internal structure of a magnetic material is phase-separated into at least a first phase and a second phase. At least one of the first phase and the second phase includes a compound having a perovskite structure. The first phase and the second phase include Mn, Sn, and N. According to this, it is possible to obtain a magnetic material in which magnetic properties such as a coercive force are improved. In addition, in a case where a rare-earth element is not included in elements that constitute the magnetic material, it is possible to obtain a magnetic material having corrosion resistance.

8 Claims, 12 Drawing Sheets

(51) Int. Cl.

| | |
|---|---|
| ***H01F 1/053*** | (2006.01) |
| ***C23C 8/24*** | (2006.01) |
| ***B22F 3/02*** | (2006.01) |
| ***B22F 3/12*** | (2006.01) |
| ***C23C 8/02*** | (2006.01) |
| ***B22F 3/24*** | (2006.01) |
| ***C22C 22/00*** | (2006.01) |
| ***H01F 1/40*** | (2006.01) |

(52) U.S. Cl.
CPC ..... *C22C 22/00* (2013.01); *C23C 8/02* (2013.01); *C23C 8/24* (2013.01); *H01F 1/407* (2013.01); *H01F 41/02* (2013.01); *B22F 2998/10* (2013.01); *B22F 2999/00* (2013.01)

(56) References Cited

U.S. PATENT DOCUMENTS

| | | | | |
|---|---|---|---|---|
| 2011/0160065 | A1* | 6/2011 | Aytug | B82Y 10/00 505/237 |
| 2014/0132376 | A1* | 5/2014 | Jin | H01F 1/0552 335/302 |
| 2017/0256448 | A1* | 9/2017 | Lakshmanan | H01L 21/76856 |

FOREIGN PATENT DOCUMENTS

| | | | |
|---|---|---|---|
| EP | 1 790 705 | A1 | 5/2007 |
| JP | H11-154609 | A | 6/1999 |
| JP | 2011-014600 | A | 1/2001 |
| JP | 2009-111176 | A | 5/2009 |
| JP | 2009-249682 | A | 10/2009 |
| JP | 2012-140324 | A | 7/2012 |
| WO | 2008/081647 | A1 | 7/2008 |

OTHER PUBLICATIONS

Xue Hua Yan et al., "Thermal Expansion of Anti-Perovskite Mn3Zn1—xSnxN Compounds", Key Engineering Materials, vol. 512-515, Jun. 1, 2012, pp. 890-893, XP055297683.

K. Isogai et al., "Microstructure and magnetic properties of Mn—X—N (X: Ni, Zr, and B) sintered alloys", Journal of Magnetism and Magnetic Materials, Elsevier Science Publishers, vol. 310, No. 2, ISSN:0304-8853, DDI:10.1016/J.JMMM.2006.11.003, Mar. 16, 2007, pp. e890-e892, XP022048635.

S. Sugimoto et al., "Coercivity and microstructure of Mn—Ni—N sintered alloys", Physica Status Solidi. C: Current Topics in Solid State Physics, vol. 4, No. 12, Dec. 1, 2007, pp. 4573-4576, XP055297627.

K. Takenaka et al., "Tailoring thermal expansion in metal matrix composites blended by antiperovskite manganese nitrides exhibiting giant negative thermal expansion", Journal of Applied Physics, American Institute of Physics, US, vol. 112, No. 8, ISSN:0021-8979, DOI:10.1063/1.4759121, Oct. 15, 2012, pp. 83517-1-83517-9, XP012167631.

Zhen Chen et al., "Negative thermal expansion and nearly zero temperature coefficient of resistivity in anti-perovskite manganese nitride Mn3CuN co-doped with Ag and Sn", Cryogenics, vol. 52, No. 11, ISSN:0011-2275, DOI:10.1016/j.cryogenics.2012.08.009, Sep. 13, 2012, pp. 629-631, XP055297681.

Lei Ding et al., "Preparation and near zero thermal expansion property of Mn3Cu0.5A0.5N (A=Ni, Sn)/Cu composites", Scripta Materialia, Elsevier, Amsterdam, NL, vol. 65, No. 8, ISSN:1359-6462, DDI:10.1016/J.Scriptamat, 2011.07.008, Jul. 5, 2011, pp. 687-690, XP028274757.

Teng-Jiao Zhou et al., "Preparation & structure of Mn3+xSn1-x and Mn3.1Sn0.9N compounds", Shenyang Shifan Daxue Xuebao, Ziran Kexueban, vol. 28, No. 1, ISSN:1673-5862, Jan. 1, 2010, pp. 30-33, XP00919474.

European Patent Office, "Extended European Search Report," dated Sep. 7, 2016 in European Patent Application No. 14 740 354.7, which is a European counterpart of U.S. Appl. No. 14/761,220, 11 pages.

Masato Sagawa et al., "Permanent Magnet—Material Science and Application", AGNE Gijutsu Center Inc., Sep. 15, 2007, pp. 170, 174 and 194.

International Searching Authority (ISA), English Translation of Written Opinion of the International Searching Authority, or International Application No. PCT/JP2014/050078 (7 pp.), Jul. 21, 2015.

* cited by examiner (A)

(B)

MAGNETIC MATERIAL AND METHOD FOR PRODUCING MAGNETIC MATERIAL

This application is a National Stage entry under 35 U.S.C. 371 of International Patent Application No. PCT/JP2014/050078, filed on Jan. 7, 2014, which claims the benefit of and priority to Japanese Patent Application No. 2013-005507, filed on Jan. 16, 2013, the entire contents of each of which are incorporated by reference herein.

TECHNICAL FIELD

The present invention relates to a magnetic material, and a method for producing the magnetic material.

BACKGROUND ART

Heretofore, an magnet which is alloy system containing a transition metal as a base is known (for example, Non-Patent Literature 1). Non-Patent Literature 1 describes that particles such as FeCo are dispersed under non-magnetism, and thus a coercive force of approximately 40 kA/m to 80 kA/m is exhibited due to shape magnetic anisotropy. In addition, as a magnet having the coercive force that is caused by the shape magnetic anisotropy, a magnet (alnico magnet) of a multicomponent alloy system containing Fe, Al, Ni, Co, Cu, and Ti as a base material is described, and the coercive force thereof is approximately 40 kA/m to 130 kA/m. In addition, as a compound which exhibits the coercive force due to magnetic anisotropy, M-type ferrite compounds such as $BaO.6Fe_2O_3$ and $SrO.6Fe_2O_3$ are described.

On the other hand, a rare-earth magnet, which is obtained by using an element such as a rare-earth element having 4f electrons, or a compound of a metalloid element such as Ga and a transition metal element such as Fe, Co, Ni, and Mn, is known (for example, Patent Literature 1). Patent Literature 1 describes that a rare-earth magnet is more excellent in magnetic properties such as the coercive force in comparison to ferrite that is a typical permanent magnet, and the like.

CITATION LIST

Patent Literature

Patent Literature 1: Japanese Unexamined Patent Application Publication No. 2011-14600

Non Patent Literature

Non-Patent Literature 1: "Eikyujisyaku-zairyo kagaku to oyo-" (Permanent Magnet-Material Science and Application) edited by Masato Sagawa, AGNE Gijutsu Center Inc., Sep. 15, 2007, page 170, page 174, and page 194

SUMMARY OF INVENTION

Technical Problem

In the magnetic material using the rare-earth element, such as the rare-earth magnet which is described in Patent Literature 1, corrosion resistance thereof is typically low, and thus it is necessary to perform coating. In addition, when a rare metal such as the rare-earth element is used as a material, an increase in the cost is caused.

Accordingly, in this technical field, there is a demand for a magnetic material which is capable of improving magnetic properties without losing the corrosion resistance.

Solution to Problem

According to an aspect of the invention, there is provided a magnetic material. An internal structure of the magnetic material is phase-separated into at least a first phase and a second phase, at least one of the first phase and the second phase includes a compound having a perovskite structure, and the first phase and the second phase include Mn, Sn, and N.

According to the magnetic material, the internal structure is phase-separated into at least the first phase and the second phase, and the phase separation occurs in such a manner that the first phase and the second phase include Mn, Sn, and N as constituent elements. At least one of the first phase and the second phase includes a compound having the perovskite structure. For example, in a case where the phase separation into two phases occurs in such a manner that the first phase mainly includes $Mn_4N$ (perovskite structure) or $Mn_3SnN$ (perovskite structure), and the second phase mainly includes α-Mn or β-Mn, it is possible to obtain a magnetic material in which the coercive force is improved. In addition, it is possible to improve the coercive force in a state in which a rate-earth element is not included in the magnetic material, and thus it is possible to make an improvement of the coercive force and the corrosion resistance compatible with each other. Accordingly, it is possible to improve magnetic properties such as the coercive force without losing the corrosion resistance.

In an embodiment, the magnetic material may further include at least one or more among Co, Fe, Cr, Nb, Ga, Cu, V, Ni, Zr, Ti, Zn, and Al as a constituent element. At least a part of elements constituting $Mn_4N$ or $Mn_3SnN$ which is included in the first phase is substituted with at least one or more elements among Co, Fe, Cr, Nb, Ga, Cu, V, Ni, Zr, Ti, Zn, and Al. When these elements are included, it is possible to further improve the magnetic properties of the magnetic material.

In an embodiment, the magnetic material may be expressed by a compositional formula $(Mn_aSn_bX_c)_{100-d}N_d$ in which $a+b+c=100$, $3 \leq a \leq 90$, $5 \leq b \leq 35$, $0 \leq c \leq 35$, and $10 \leq d$, and the element X may be at least one kind selected from the group consisting of Co, Fe, Cr, Nb, Ga, Cu, V, Ni, Zr, Ti, Zn, and Al. According to this composition, it is possible to further improve the magnetic properties of the magnetic material without losing the corrosion resistance.

According to another aspect of the invention, there is provided a method for producing the above-described magnetic material. The method includes a melting step of melting metallic constituent elements except for nitrogen to form an alloy, a powdering step of atomizing the alloy which is obtained in the melting step, and a heat treatment step of subjecting a powder, which is obtained in the powdering step, to a heat treatment in an atmosphere in which a nitrogen source is contained.

With regard to the producing method, first, in the melting step, elements except for nitrogen (N) among elements which constitute the magnetic material are melted, and thus a metal alloy is obtained. In addition, in the powdering step, the metal alloy, which is obtained in the melting step, is atomized. In addition, in the heat treatment step, a powder of an alloy, which is obtained in the powdering step, is subjected to a heat treatment in an atmosphere in which a nitrogen source is contained, and becomes a sintered body. In addition, in the melting step, in a case where at least one element selected from the group consisting of Co, Fe, Cr, Nb, Ga, Cu, V, Ni, Zr, Ti, Zn, and Al, Mn, and Sn are melted together, a magnetic material, in which at least a part of elements constituting $Mn_4N$ or $Mn_3SnN$ is substituted with at least one element selected from the group consisting of Co, Fe, Cr, Nb, Ga, Cu, V, Ni, Zr, Ti, Zn, and Al, is obtained. In this manner, it is possible to produce a magnetic material in which magnetic properties are improved. In addition, it is possible to produce a magnetic material in a state in which a rare-earth element is not included in the magnetic material, and thus it is possible to produce a magnetic material in which an improvement of the coercive force and the corrosion resistance are compatible with each other. Accordingly, it is possible to produce a magnetic material in which magnetic properties such as the coercive force are improved without losing the corrosion resistance.

In an embodiment, the method may further include a molding step of compression-molding the powder that is obtained in the powdering step, and in the heat treatment step, a molded body, which is obtained in the molding step, may be subjected to the heat treatment in the atmosphere in which the nitrogen source is contained. According to this configuration, it is possible to produce a magnetic material that is a bulk body obtained by compression-molding a powder.

According to still another aspect of the invention, there is provided a method for producing the above-described magnetic material. The method includes a mixing step of mixing a nitride powder or a metal powder which includes an element that constitutes the magnetic material, a molding step of compression-molding a powder that is mixed in the mixing step, and a heat treatment step of subjecting a molded body, which is molded in the molding step, to a heat treatment in an atmosphere in which a nitrogen source is contained.

With regard to this producing method, first, in the mixing step, the nitride powder or the metal powder which constitutes the magnetic material is mixed. In addition, in the molding step, the mixed powder is compression-molded. In addition, in the heat treatment step, the nitride powder or the metal powder which is compression-molded in the molding step is subjected to the heat treatment in the atmosphere containing the nitrogen source. Accordingly, it is possible to produce a sintered body that includes, for example, $Mn_4N$ or $Mn_3SnN$. Here, powdered Mn may be a powdered Mn that is nitrided. In addition, in a case of subjecting a powder including at least one kind of element selected from the group consisting of Co, Fe, Cr, Nb, Ga, Cu, V, Ni, Zr, Ti, Zn, and Al, and powders of Mn and Sn to the heat treatment in combination with each other, it is possible to produce a sintered body in which at least a part of elements constituting $Mn_4N$ or $Mn_3SnN$ is substituted with at least one kind of element selected from the group consisting of Co, Fe, Cr, Nb, Ga, Cu, V, Ni, Zr, Ti, Zn, and Al. In this manner, it is possible to produce a magnetic material in which magnetic properties are improved. In addition, it is possible to produce a magnetic material in a state in which a rare-earth element is not included in the magnetic material, and thus it is possible to produce a magnetic material in which an improvement of the coercive force and the corrosion resistance are compatible with each other. Accordingly, it is possible to produce a magnetic material in which magnetic properties such as the coercive force are improved without losing the corrosion resistance.

In an embodiment, in the heat treatment step, the heat treatment may be performed in a magnetic field. According to this configuration, it is possible to produce a magnetic material with high magnetic anisotropy. In addition, it is possible to produce the magnetic material while controlling a magnetization direction, and thus it is possible to manufacture a magnetic material in which the magnetic properties such as the coercive force are improved.

Advantageous Effects of Invention

As described above, according to various aspects and embodiments of the invention, it is possible to provide a magnetic material capable of improving magnetic properties without losing the corrosion resistance.

Figure 3:
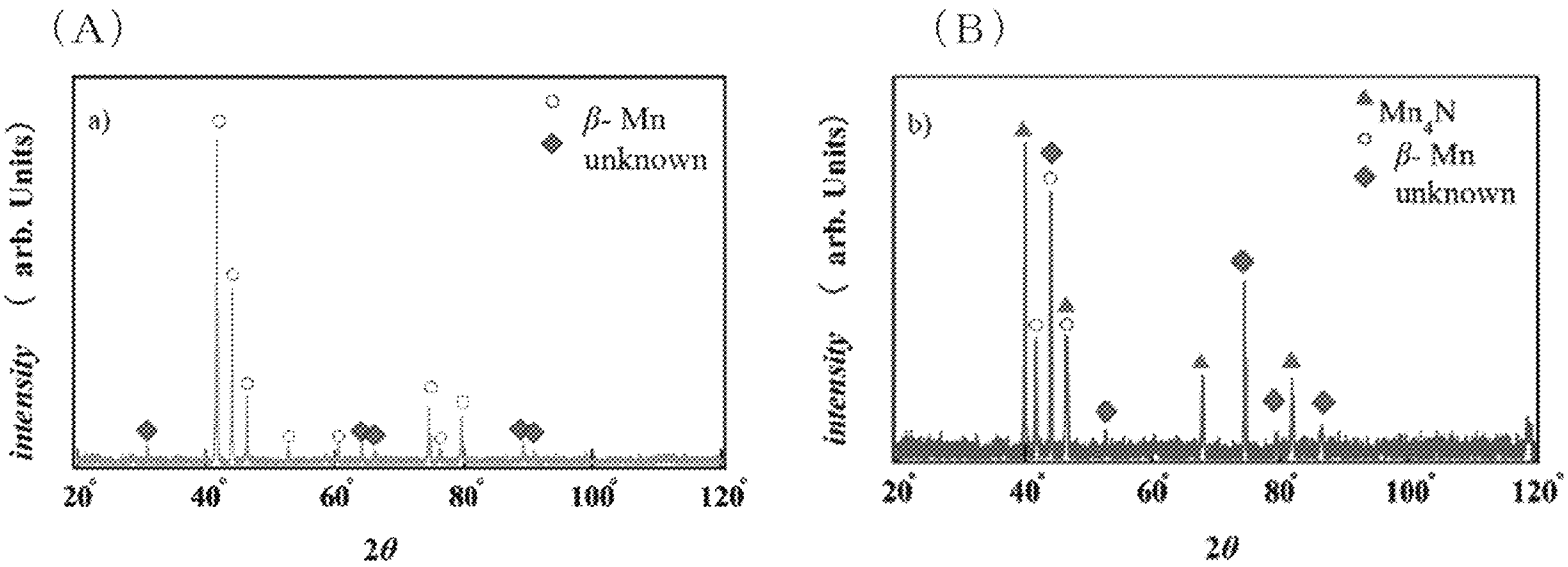

(A) of FIG. 3 is a view illustrating an X-ray diffraction pattern result of $Mn_{85}Sn_5Co_{10}$ before a nitriding treatment, and (B) of FIG. 3 is a view illustrating an X-ray diffraction pattern result of $Mn_{85}Sn_5Co_{10}$ after the nitriding treatment.

Figure 4:
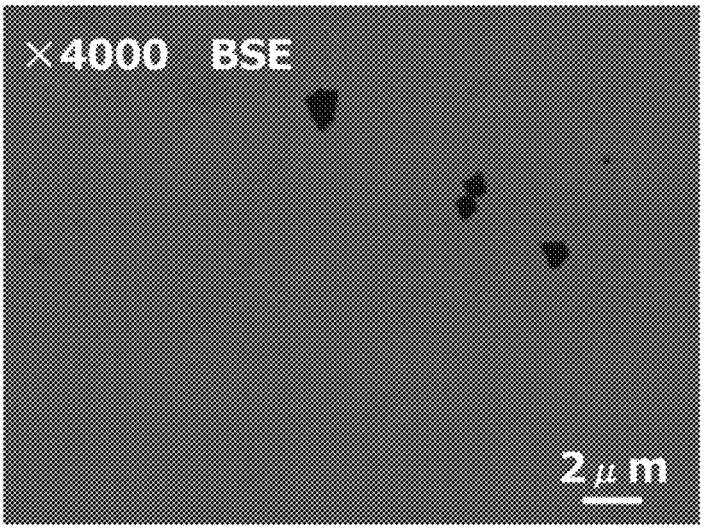

FIG. 4 is a view illustrating a reflected electron image of $Mn_{85}Sn_5Co_{10}$ before the nitriding treatment.

Figure 5:
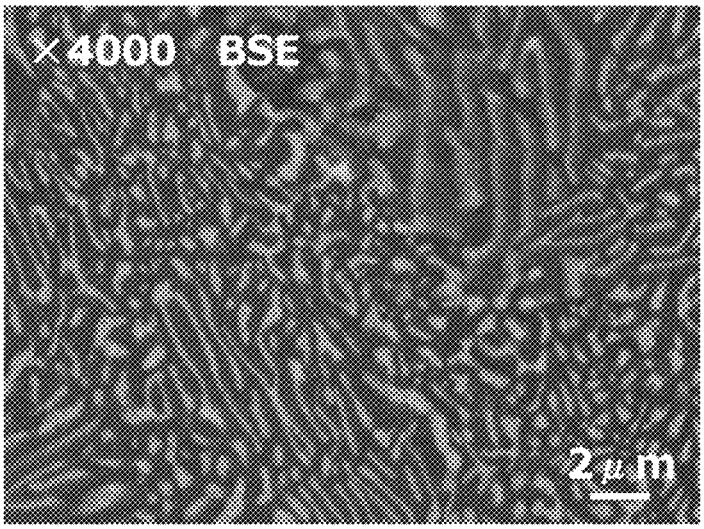

FIG. 5 is a view illustrating a reflected electron image of $Mn_{85}Sn_5Co_{10}$ after the nitriding treatment.

Figure 6:
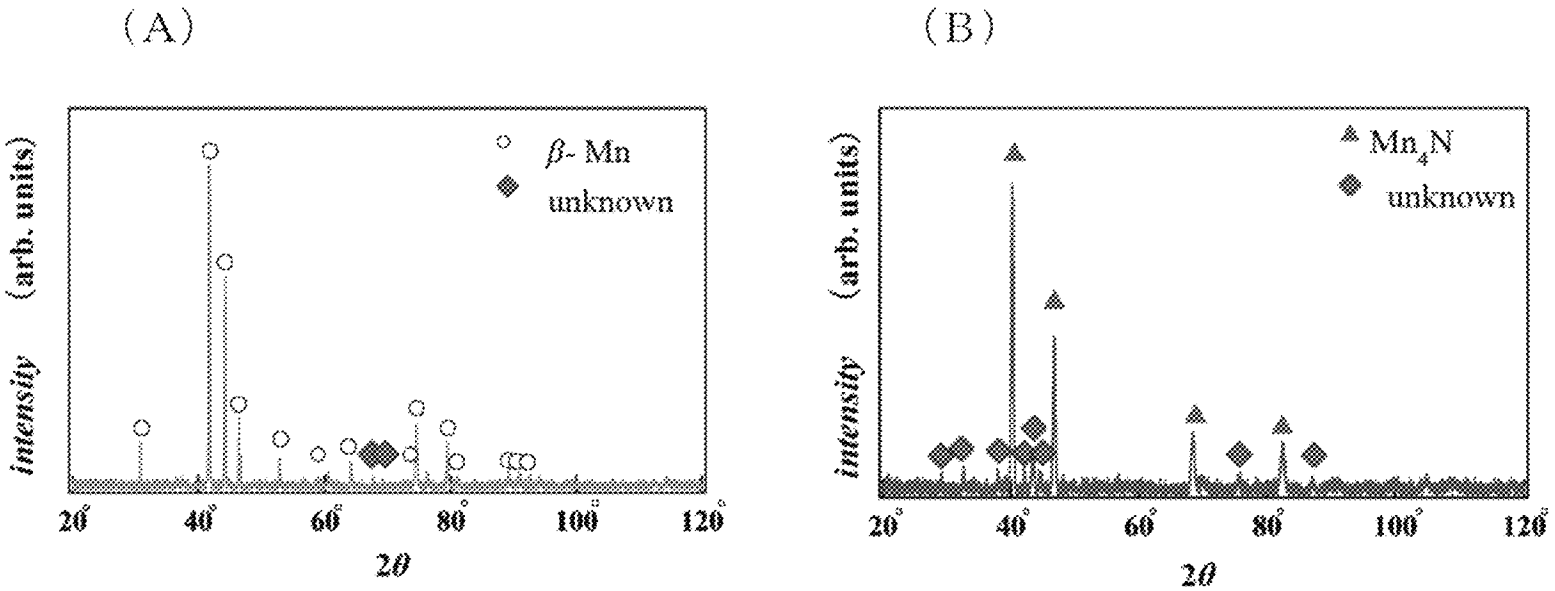

(A) of FIG. 6 is a view illustrating an X-ray diffraction pattern result of $Mn_{70}Sn_{15}Fe_{15}$ before the nitriding treatment, and (B) of FIG. 6 is a view illustrating an X-ray diffraction pattern result of $Mn_{70}Fe_{15}Sn_{15}$ after the nitriding treatment.

Figure 7:
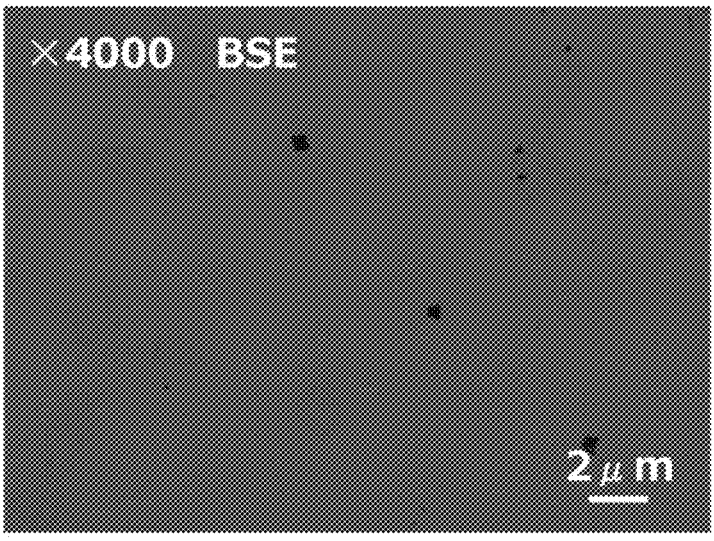

FIG. 7 is a view illustrating a reflected electron image of $Mn_{70}Sn_{15}Fe_{15}$ before the nitriding treatment.

Figure 8:
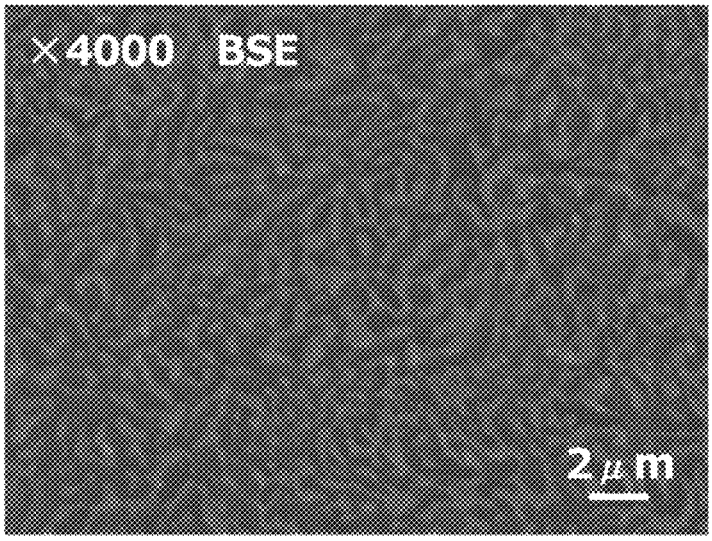

FIG. 8 is a view illustrating a reflected electron image of $Mn_{70}Sn_{15}Fe_{15}$ after the nitriding treatment.

Figure 9:
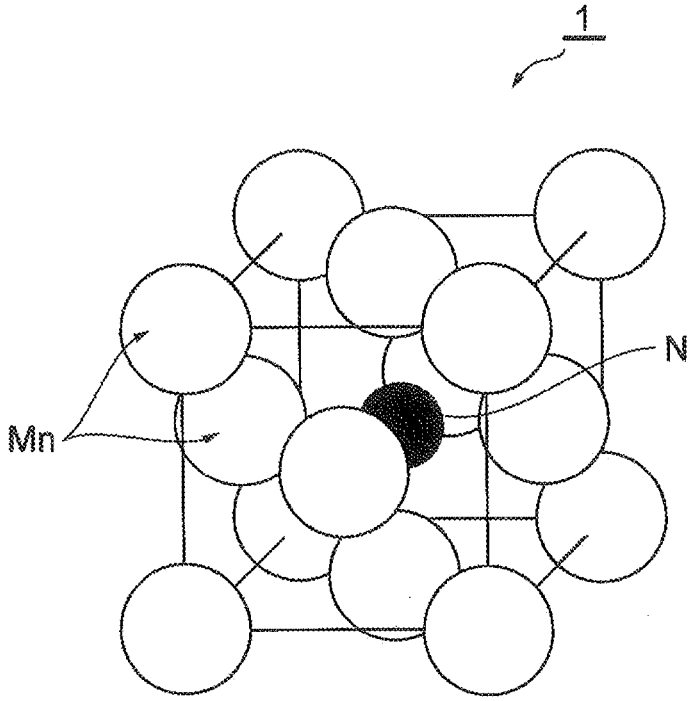

FIG. 9 is a view illustrating a crystal structure of a first phase in a first embodiment.

Figure 10:
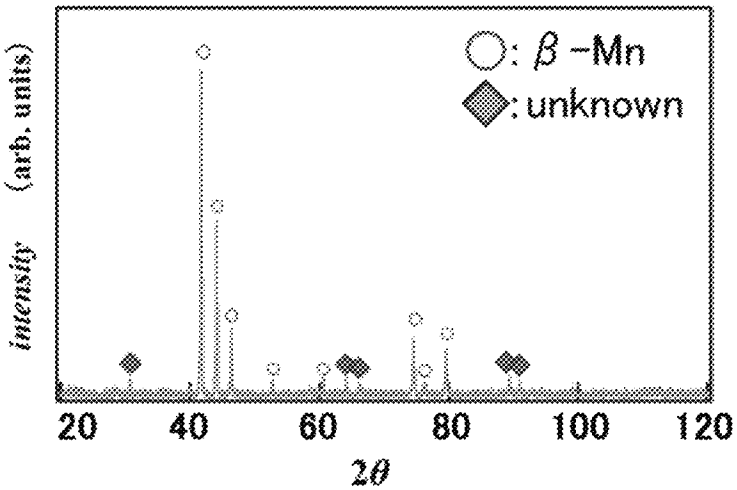
Figure 10:
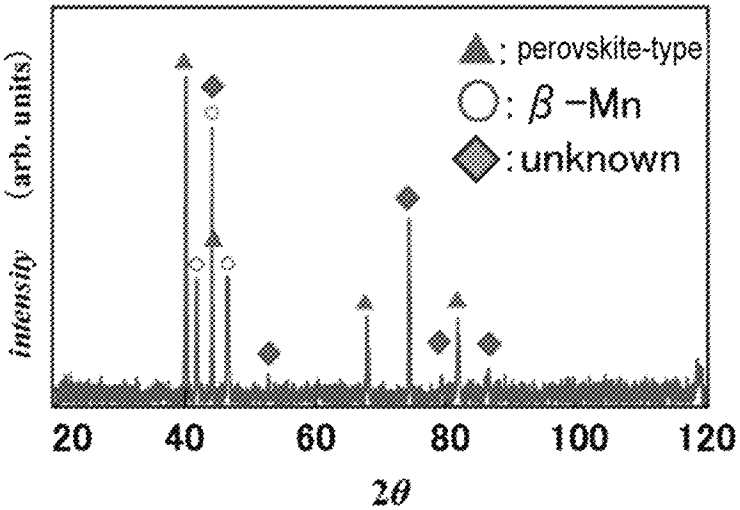

(A) of FIG. 10 is a view illustrating an X-ray diffraction pattern result of a magnetic material before the nitriding treatment, and (B) of FIG. 10 is a view illustrating an X-ray diffraction pattern result of the magnetic material after the nitriding treatment.

Figure 11:
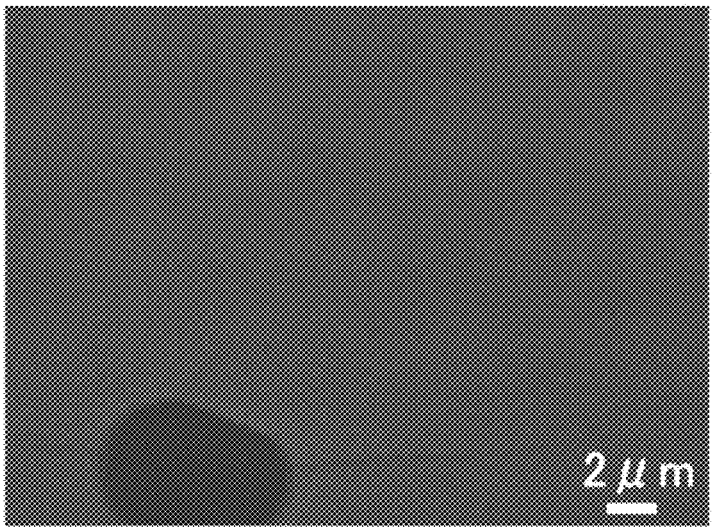

FIG. 11 is a view illustrating a reflected electron image of the magnetic material before the nitriding treatment.

Figure 12:
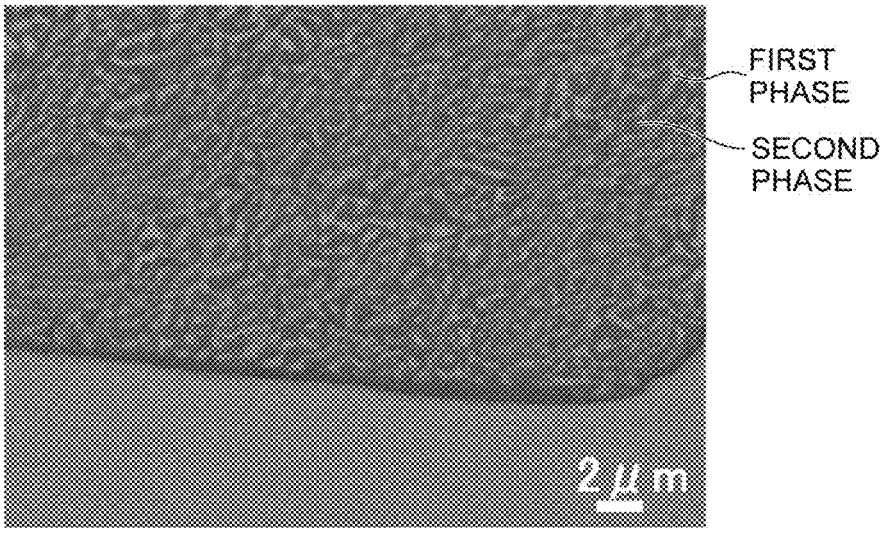

FIG. 12 is a view illustrating a reflected electron image of the magnetic material after the nitriding treatment.

DESCRIPTION OF EMBODIMENTS

Hereinafter, an embodiment of the invention will be described in detail with reference to the accompanying drawings.

(Magnetic Material)

A magnetic material contains Mn, Sn, and N as a constituent element to construct an inner structure. The inner structure of the magnetic material is phase-separated into at least a first phase and a second phase. At least one of the first phase and the second phase includes a compound having a perovskite structure. In addition, in this embodiment, the perovskite structure includes a distorted perovskite type and an inverse perovskite type.

The first phase and the second phase include Mn, Sn, and N. Through phase separation, for example, the magnetic material is separated into a phase in which a first phase mainly includes $Mn_4N$ or $Mn_3SnN$, and a phase in which a second phase mainly includes $\alpha$-Mn or $\beta$-Mn. That is, the first phase is formed as a magnetic phase, and a value of magnetization is exhibited due to $Mn_4N$ or $Mn_3SnN$ of the first phase. In addition, as described above, when the phase separation into two phases occurs, and the first phase that is a magnetic phase precipitates in the second phase as a minute structure, the coercive force is improved. In addition, a rare-earth element is not included in elements which constitute the magnetic material, and thus it is possible to obtain a magnetic material having the corrosion resistance.

Here, a crystal structure of the first phase according to this embodiment will be described with reference to FIG. 9. The first phase includes a compound having a perovskite structure 1. Examples of the compound include $Mn_4N$. In this case, ideally, the perovskite structure 1 has a cubic unit lattice constituted by Mn and N. A Mn atom is disposed at each vertex of the cubic. The Mn atom is disposed at each face center of the cubic. An N atom is disposed at each body center of the cubic. In the perovskite structure 1, $Mn_4N$ is easily distorted due to interaction between atoms, and thus a crystal structure thereof easily varies. That is, $Mn_4N$ may have a crystal structure in which symmetry is different from that of the cubic. $Mn_4N$ may have a crystal structure in which a part of the crystal structure is substituted with another atom.

In addition, in the magnetic material, a part of $Mn_4N$ or $Mn_3SnN$ may contain at least one or more elements among Co, Fe, Cr, Nb, Ga, Cu, V, Ni, Zr, Ti, Zn, and Al. In this case, at least a part of elements which constitute $Mn_4N$ or $Mn_3SnN$ of the first phase is substituted with at least one or more elements among Co, Fe, Cr, Nb, Ga, Cu, V, Ni, Zr, Ti, Zn, and Al. When substitution with the above-described elements occurs, an element excellent in magnetic properties can be contained in the magnetic material, and the lattice constant of $Mn_4N$ or $Mn_3SnN$ varies due to the substituted element, and this variation has a satisfactory effect on the magnetic properties. Accordingly, it is possible to improve the magnetic properties of the magnetic material. So as to obtain an effect of improving the coercive force, an element, which is substituted with an element that constitutes $Mn_4N$ or $Mn_3SnN$, may be set to at least one kind selected from the group consisting of Co, Nb, Ga, Zr, Ti, Zn, and Al. In addition, so as to obtain an effect of improving saturated magnetization, the element, which is substituted with the element that constitutes $Mn_4N$ or $Mn_3SnN$, may be set to at least one kind that is selected from the group consisting of Fe, Cr, Cu, V, and Ni. Furthermore, as described above, $Mn_4N$ or $Mn_3SnN$, in which at least a part thereof is substituted with at least one or more elements among Co, Fe, Cr, Nb, Ga, Cu, V, Ni, Zr, Ti, Zn, and Al, is a compound having a perovskite structure.

In addition, the magnetic material may be expressed by a compositional formula $(Mn_aSn_bX_c)_{100-d}N_d$ in which $a+b+c=100$, $30 \le a \le 90$, $5 \le b \le 35$, $0 \le c \le 35$, and $10 \le d$, and the element X may be at least one kind selected from the group consisting of Co, Fe, Cr, Nb, Ga, Cu, V, Ni, Zr, Ti, Zn, and Al. For example, a constitution ratio of respective elements which constitute the magnetic material may be appropriately determined in accordance with magnetic properties such as the coercive force and the saturated magnetization which are desired.

According to the above-described configuration, it is possible to realize a magnetic material which is inexpensive than a rare-earth-transition metal compound, a platinum group-transition metal compound, and a Ga-transition metal compound which are known as a material with a high-coercive-force, which has the coercive force higher than that of an magnet which is alloy system and an M-type ferrite compound, and which has the corrosion resistance higher than that of a rare-earth magnet.

In addition, the magnetic material may be constituted by elements not including a rare-earth element. Even in a case where the magnetic material does not include the rare-earth element, the operation and effect of the invention can be obtained.

(Structure Evaluation of Magnetic Material)

In this embodiment, a structure of $Mn_{80}Co_{10}Sn_{10}$ as the magnetic material is evaluated. In the structure evaluation, an X-ray diffraction device and a scanning electron microscope are used. (A) of FIG. 10 is an X-ray diffraction pattern in the magnetic material before a nitriding treatment. (B) of FIG. 10 is an X-ray diffraction pattern in the magnetic material after the nitriding treatment.

As illustrated in (A) of FIG. 10, it is confirmed that the magnetic material before the nitriding treatment contains β-Mn. In addition, as illustrated in (B) of FIG. 10, it is confirmed that when the magnetic material is subjected to the nitriding treatment at 900° C., the perovskite structure is exhibited. As described above, it is confirmed that the perovskite structure is exhibited after the nitriding treatment.

FIG. 11 is a reflected electron image of the magnetic material before the nitriding treatment, and FIG. 12 is a reflected electron image of the magnetic material after the nitriding treatment.

As illustrated in FIG. 11, it is confirmed that the magnetic material before the nitriding treatment has an approximately single phase structure. From the X-ray diffraction pattern result in (A) of FIG. 10, it is considered that the magnetic material before the nitriding treatment has β-Mn single phase.

On the other hand, as illustrated in FIG. 12, it is confirmed that the magnetic material after the nitriding treatment has a structure that is separated into two phases. From the X-ray diffraction pattern result in (B) of FIG. 10, it is considered that the magnetic material after the nitriding treatment has a structure separated into two phases which include a phase including a compound having the perovskite structure, and β-Mn single phase.

In addition, in the magnetic material after the nitriding treatment as illustrated in FIG. 12, a width of a different structure is 2 μm or less. As described above, it is confirmed that the structure inside the magnetic material after the nitriding treatment is made fine.

As described above, from the results in FIG. 10 to FIG. 12, it is confirmed that when a magnetic phase mainly including the perovskite structure precipitates, magnetization is exhibited in the magnetic material. In addition, when phase separation into the phase mainly having the perovskite structure and the phase containing β-Mn occurs, and the magnetic phase mainly having the perovskite structure is made fine, it is considered that magnetic properties such as the coercive force and the saturated magnetization are improved.

(First Method for Producing Magnetic Material)

Figure 1:
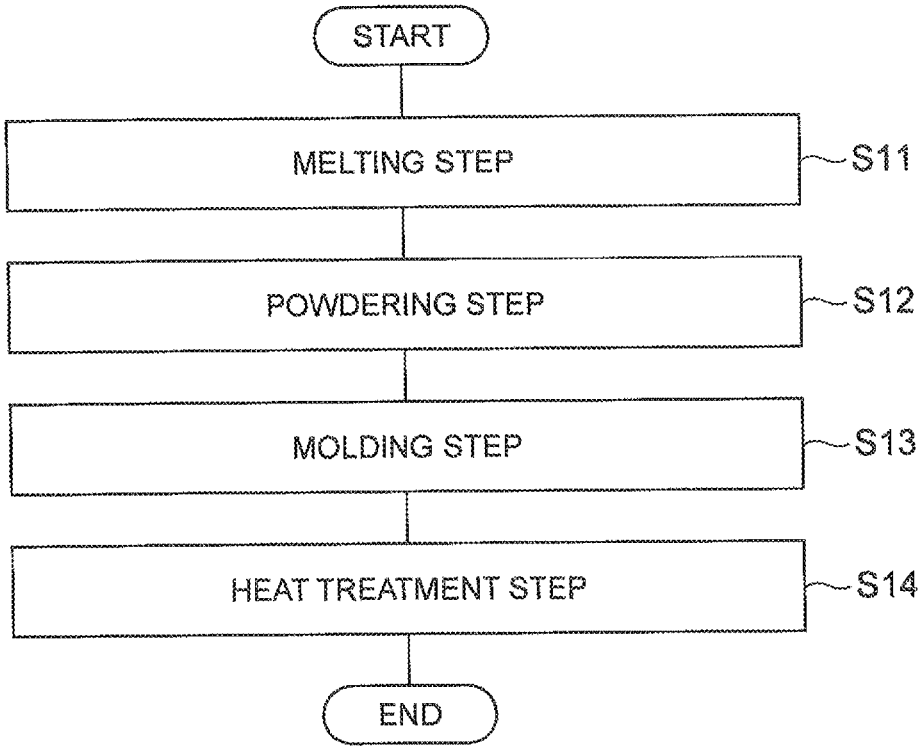
FIG. 1 is a flowchart illustrating a flow in a first method for producing a magnetic material.

Hereinafter, a method for producing the magnetic material according to a first embodiment will be described. FIG. 1 illustrates the first method for producing the magnetic material according to this embodiment. In the first production method, the magnetic material is produced through a melting step, a powdering step, a molding step, and a heat treatment step. Respective processes will be described below. Furthermore, a preferred method for producing the magnetic material is not limited to the following method, and a material that is used, process conditions, and the like may be appropriately changed.

In a melting step S11, raw materials of the magnetic material are blended, and the blended raw materials of the magnetic material are subjected to arc melting, high-frequency melting, or the like to obtain a metal alloy. As the raw materials of the magnetic material, a compound, which includes one or more kinds of elements except for nitrogen among elements (metallic constituent elements) which constitute the magnetic material, can be used. For example, Mn and Sn can be used. In addition to these, at least one kind of element, which is selected from the group consisting of Fe, Co, Cr, Nb, Ga, Cu, V, Ni, Zr, Ti, Zn, and Al, may be included to the compound. For example, in a case of producing a magnetic material that includes MnSn as a main component, only Mn and Sn may be selected as a material. In addition, for example, in a case of producing a magnetic material that includes MnSnFe as a main component, only Mn, Sn, and Fe may be selected as a material. In this manner, in melting step S11, materials which are weighed and blended to obtain a desired composition are melted through the arc melting, the high-frequency melting, or the like. Furthermore, the raw materials of the magnetic material may be an oxide including an element that constitutes the magnetic material, or a compound (a carbonate, a hydroxide, a nitrate, and the like) that becomes an oxide through firing. In addition, other raw material compounds (a single element, an oxide, and the like) which are sub-components may be blended as necessary.

In powdering step S12, for example, a water atomization method, a gas atomization method, and the like can be employed. In a case of using the water atomization method, an alloy obtained in melting step S11 is made into a molten metal in a crucible, the molten metal is allowed to flow out from a small hole formed in the bottom of the crucible, high-pressure water is sprayed to the molten metal to cool down the molten metal with water, and then solidification and powdering are performed. Alternatively, in a case of using the gas atomization method, an alloy obtained in melting step S11 is made into a molten metal in a crucible, the molten metal is allowed to flow out from a small hole formed in the bottom of the crucible, high-pressure gas is sprayed to the molten metal to air cool the molten metal, and then solidification and powdering are performed. As a gas that can be used in the gas atomization method, an inert gas may be used, and for example, an argon gas may be used. Alternatively, a nitrogen-containing gas may be used instead of the inert gas. In addition, the gas atomization method and the water atomization method may be used in combination with each other.

In molding step S13, the powder (raw material powder) that is obtained in powdering step S12 is subjected to compression molding. A molding pressure may be set to approximately $5\times10^7$ kg/m$^2$. Furthermore, in molding step S13, pressing molding may be performed by using a mold. In the mold, a cross-sectional shape of a plane perpendicular to a pressing direction may be an approximately polygonal shape or an approximately circular shape. In addition, a cross-sectional shape of a plane perpendicular to the pressing direction may be an approximately circular shape having a diameter (ϕ) of approximately 8 mm to 14 mm.

In heat treatment step S14, a molded body obtained in molding step S13 is fired (is subjected to a heat treatment) in an atmosphere in which a nitrogen source is contained to obtain a sintered body. The nitrogen source may be gas nitrogen or a gas nitrogen compound (ammonia and the like). For example, the firing is performed in a nitrogen atmosphere, and the firing temperature may be set to a temperature range of 900° C. to 1250° C. Time for which the firing temperature is retained may be set to 10 hours or shorter, or 5 hours or shorter. In addition, after the firing, temperature-lowering is performed to 300° C. at a temperature gradient of approximately 0.5° C., thereby obtaining a fired body. Furthermore, the time for which the firing temperature is retained, the temperature-lowering time, and the temperature gradient may be approximately changed in accordance with a composition. In heat treatment step S14, a powder of Mn and Sn which are nitrided is sintered, thereby obtaining a magnetic material including $Mn_4N$ or $Mn_3SnN$ in the first phase. In addition, in a case where the powder of Mn and Sn includes at least one kind of element selected from the group consisting of Co, Fe, Cr, Nb, Ga, Cu, V, Ni, Zr, Ti, Zn, and Al, a magnetic material, in which at least a part of elements which constitute $Mn_4N$ or $Mn_3SnN$ is substituted with at least one kind of element selected from the group consisting of Co, Fe, Cr, Nb, Ga, Cu, V, Ni, Zr, Ti, Zn, and Al, is produced.

The process in FIG. 1 is terminated as described above. Furthermore, the process in the above-described powdering step S12 may employ a pulverization method. In the case of using the pulverization method, the pulverization method may be performed by a two-step process in which the alloy obtained in melting step S11 is roughly pulverized to be, for example, a rough powder (rough pulverization), and then the rough powder is further finely pulverized (fine pulverization). In addition, a preferred pulverization time may be approximately set in accordance with a pulverization method, and for example, may be set to approximately 1 hour to 10 hours. In addition, a product type is set to a powder for a bonded magnet which is used in a powder shape, molding step S13 may be omitted.

In addition, in heat treatment step S14, the fired body may be obtained through a heat treatment in a magnetic field. A magnetic field that is applied may be set to a static magnetic field of 500 kA/m or higher (for example, approximately 2000 kA/m). In this case, it is possible to obtain a sintered body of a nitride with high magnetic anisotropy. In addition, it is possible to produce a magnetic material while controlling a magnetization direction, and thus it is possible to produce a magnetic material in which the coercive force or the value of the saturated magnetization is relatively high.

As described above, according to the first production method, the raw materials are melted to form an alloy, the alloy that is obtained is powderized, the resultant powder is molded, and the resultant molded body is nitrided, thereby producing the magnetic material according to this embodiment.

(Second Method for Producing Magnetic Material)

Figure 2:
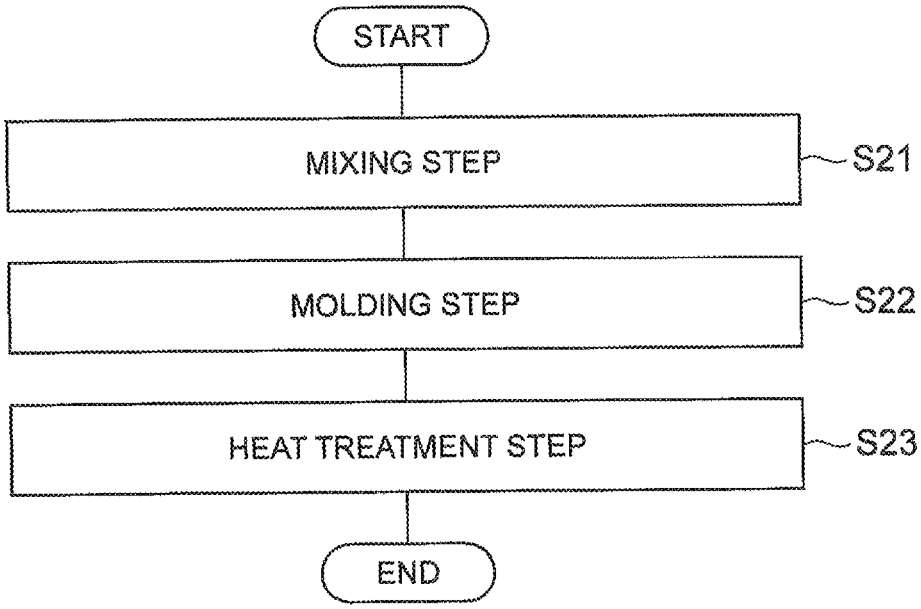
FIG. 2 is a flowchart illustrating a flow in a second method for producing the magnetic material.

Hereinafter, a second method for producing the magnetic material will be described. FIG. 2 is a flowchart illustrating the second method for producing the magnetic material. According to the second production method, the magnetic material is produced through a mixing step, a molding step, and a heat treatment step. Respective processes will be described below. Furthermore, a preferred method for producing the magnetic material is not limited to the following method, and a material that is used, process conditions, and the like may be appropriately changed.

First, in mixing step S21, raw materials of the magnetic material are blended to obtain a raw material composition. Examples of the raw materials of the magnetic material include a compound that includes one or more kinds of elements which constitute the magnetic material. For example, Mn and Sn may be used. In addition, at least one kind of element, which is selected from the group consisting of Fe, Cr, Nb, Ga, Cu, V, Ni, Zr, Ti, Zn, and Al, may be included to the compound. In addition, a nitride powder or a metal powder which includes elements which constitute the magnetic material may be mixed.

In addition, in mixing step S21, respective raw materials are weighed and mixed with each other to obtain a desired composition of the magnetic material. After mixing the respective raw materials, the resultant mixture is mixed and pulverized by using a pulverizer such as a ball mill. In this manner, the nitride powder or the metal powder which constitutes the magnetic material is mixed in the mixing step. Furthermore, it is not necessary to mix all raw materials in mixing step S21, and parts of the raw materials may be added after molding step S22 to be described later.

Next, in molding step S22, the raw material powder that is obtained in mixing step S21 is compression-molded. A molding pressure may be set to approximately $5\times10^7$ kg/m$^2$. Furthermore, in the molding step, pressing molding may be performed by using a mold. In the mold, a cross-sectional shape of a plane perpendicular to a pressing direction may be an approximately polygonal shape or an approximately circular shape. In addition, a cross-sectional shape of a plane perpendicular to the pressing direction may be an approximately circular shape having a diameter of approximately 8 mm to 14 mm In heat treatment step S23, a molded body obtained in molding step S22 is fired (is subjected to a heat treatment) in an atmosphere in which a nitrogen source is contained to obtain a sintered body. The nitrogen source may be gas nitrogen or a gas nitrogen compound (ammonia and the like). For example, the firing is performed in a nitrogen atmosphere, and the firing temperature may be set to a temperature range of 900° C. to 1250° C. Time for which the firing temperature is retained may be set to 10 hours or shorter, or 5 hours or shorter. In addition, after the firing, temperature-lowering is performed to 300° C. at a temperature gradient of approximately 0.5° C., thereby obtaining a fired body. In heat treatment step S23, a powder of Mn and Sn which are nitrided becomes a sintered body including $Mn_4N$ or $Mn_3SnN$. In addition, in a case where the powder of Mn and Sn includes at least one kind of element selected from the group consisting of Co, Fe, Cr, Nb, Ga, Cu, V, Ni, Zr, Ti, Zn, and Al, a magnetic material, in which at least a part of elements which constitute $Mn_4N$ or $Mn_3SnN$ is substituted with at least one kind of element selected from the group consisting of Co, Fe, Cr, Nb, Ga, Cu, V, Ni, Zr, Ti, Zn, and Al, is produced.

Furthermore, in heat treatment step S23, the fired body may be obtained through a heat treatment in a magnetic field. For example, a magnetic field that is applied may be set to a static magnetic field of 500 kA/m or higher (for example, approximately 2000 kA/m). In this case, it is possible to obtain a sintered body of a nitride with high magnetic anisotropy. In addition, it is possible to produce a magnetic material while controlling a magnetization direction, and thus it is possible to produce a magnetic material in which the coercive force or the value of the saturated magnetization is relatively high.

As described above, according to the second production method, it is possible to produce the magnetic material according to this embodiment by molding a mixed metal powder and nitriding the resultant molded body.

As described above, the magnetic material and the production method thereof according to a preferred embodiment have been described. However, the magnetic material that is obtained by this embodiment, and the production method thereof are not limited to the above-described embodiment, and modification or application to other configuration is possible.

In the above-described embodiment, description has been given of an example in which the first phase includes a compound having a perovskite structure, but there is no limitation thereto. For example, the first phase and the second phase may include a compound having the perovskite structure. Even in this configuration, it is possible to attain the above-described operation and effect.

EXAMPLES

Hereinafter, Examples and Comparative Examples which were carried out by the present inventors for illustration of the above-described effect will be described.

[Variation of Magnetic Properties and Structure in Accordance with Presence or Absence of Nitriding Treatment: MnSn Magnetic Material and MnSnCo Magnetic Material]

Example 1

With Nitriding Treatment

A magnetic material was produced on the basis of the first production method. First, as raw materials of main components of the magnetic material, an electrolytic metal Mn with a purity of 99.9% and in a chip shape of 5 mm to 20 mm, Co in a shot shape having a particle size of 5 mm to 8 mm, and Sn in a shot shape having a particle size of 2 mm to 4 mm were prepared. In addition, these raw materials were weighed with an electronic balance to realize a compositional formula: $Mn_{95-c}Sn_5Co_c$ (c=0, 5, 10, 15, 20, 25, 30, 35, 40, and 50), and the sum of the raw materials in each composition was set to 30 g. The respective raw materials which were weighed were subjected to arc melting to form an alloy (melting step). In addition, this alloy was subjected to a heat treatment at 900° C. for 20 hours in an Ar atmosphere. An alloy lump that was obtained was crushed in an iron bowl, and the resultant powder was sorted with a sieve to obtain a powder of 500 μm to 1 mm (powdering step). The powder that was obtained was subjected to a heat treatment in a nitrogen atmosphere at 900° C. for 5 hours, and then temperature-lowering was performed to 300° C. at a rate of 0.5° C./min (heat treatment step). According to this, a magnetic material $(Mn_{95-c}Sn_5Co_c)_{100-d}N_d$ (0<d) was prepared.

Comparative Example 1

Without Nitriding Treatment

Production was performed in the same manner as in Example 1 except that the process was stopped before performing the nitriding treatment (before the heat treatment step) in Example 1.

(Evaluation of Magnetic Properties of MnSn Magnetic material and MnSnCo magnetic Material)

Magnetic measurement of the magnetic materials of Example 1 and Comparative Example 1 was performed to obtain the coercive force $H_c$ and a saturated magnetization $J_s$. As measurement conditions, the maximum applied magnetic field was set to 1600 kA/m (20 kOe). The magnetic properties were measured by using VSM manufactured by Riken Denshi Co., Ltd. As measurement conditions, a temperature was set to room temperature, and a maximum applied magnetic field was set to 1600 kA/m (20 kOe).

Obtained results are collectively illustrated in FIG. 1

TABLE 1

| | Co (c value) | 0 | 5 | 10 | 15 | 20 | 25 | 30 | 35 | 40 | 50 |
|---|---|---|---|---|---|---|---|---|---|---|---|
| Before nitriding treatment (Comparative Example 1) | Saturated magnetization $J_s$ (mT) | 8 | 11 | 8 | 7 | 5 | 15 | 21 | 14 | 23 | 32 |
| | Coercive force $H_c$ (kA/m) | 35 | 42 | 56 | 52 | 43 | 52 | 65 | 52 | 34 | 36 |
| After nitriding treatment (Example 1) | Saturated magnetization $J_s$ (mT) | 152 | 136 | 125 | 118 | 115 | 115 | 110 | 104 | 38 | 25 |
| | Coercive force $H_c$ (kA/m) | 160 | 460 | 858 | 407 | 336 | 220 | 196 | 201 | 153 | 149 |

As illustrated in Table 1, with regard to the MnSn magnetic material (c=0), in the magnetic material after the nitriding treatment (Example 1), values of the saturated magnetization $J_s$ and the coercive force $H_c$ were further raised in comparison to the magnetic material before the nitriding treatment (Comparative Example 1). From these results, it was confirmed that when the MnSn magnetic material was subjected to the nitriding treatment, the magnetic properties could be improved. In addition, the coercive force $H_c$ exhibited a value of 160 kA/m (2 kOe) or greater and the saturated magnetization $J_s$ exhibited a value of 100 mT (1000 G) or greater. From these results, it was confirmed that the MnSn magnetic material is a high-coercive-force material in which the coercive force $H_c$ is greater than that of a magnet which is alloy system in the related art.

In addition, as illustrated in Table 1, with regard to the MnSnCo magnetic material (0<c), in the magnetic material after the nitriding treatment (Example 1), the values of the saturated magnetization $J_s$ and the coercive force $H_c$ were further raised in comparison to the magnetic material before the nitriding treatment (Comparative Example 1). From these results, it was confirmed that when the MnSnCo magnetic material was subjected to the nitriding treatment, the magnetic properties could be improved. The coercive force $H_c$ exhibited a value of 160 kA/m (2 kOe) or greater when a composition ratio c of Co was in a range of 0<c 35, and the saturated magnetization $J_s$ exhibited a value of 100 mT (1000 G) or greater in the range of 0<c 35. From these results, it could be confirmed that the MnSnCo magnetic material is a high-coercive-force material in which the coercive force $H_c$ is greater than that of the magnet which is alloy system and the M-type ferrite of the related art.

In addition, as illustrated in Table 1, when comparing the MnSn magnetic material (c=0) and the MnSnCo magnetic material (0<c ≤35) after the nitriding treatment, in a case of containing Co, the saturated magnetization $J_s$ did not vary too much in comparison to a case of not containing Co, but the coercive force $H_c$ was greatly improved. As described above, it was confirmed that it is effective to appropriately contain Co so as to improve the coercive force $H_c$.

(Structure Evaluation of MnSnCo Magnetic Material)

The structure of Example 1 ($(Mn_{85}Sn_5Co_{10})_{100-d}N_d$ (0<d)) in which c was set to 10 and the structure of Comparative Example 1 ($Mn_{85}Sn_5Co_{10}$) in which c was set to 10 were evaluated. In the structure evaluation, an X-ray diffraction device and a scanning electron microscope were used. (A) of FIG. 3 is an X-ray diffraction pattern in the magnetic material before the nitriding treatment (Comparative Example 1). (B) of FIG. 3 is an X-ray diffraction pattern in the magnetic material after the nitriding treatment (Example 1).

As illustrated in (A) of FIG. 3, it was confirmed that the magnetic material ($Mn_{85}Sn_5Co_{10}$) of Comparative Example 1 contained β-Mn. In addition, as illustrated in (B) of FIG. 3, it was confirmed that the magnetic material ($(Mn_{85}Sn_5Co_{10})_{100-d}N_d$ (0<d)) of Example 1 contained $Mn_4N$ and β-Mn. As described above, it was confirmed that $Mn_4N$ that is ferrimagnetism was exhibited after the nitriding treatment.

FIG. 4 is a reflected electron image of the magnetic material of Comparative Example 1, and FIG. 5 is a reflected electron image of the magnetic material of Example 1. As illustrated in FIG. 4, it was confirmed that the magnetic material of Comparative Example 1 had an approximately single phase structure. From the X-ray diffraction pattern result in (A) of FIG. 3, it is considered that the magnetic material of Comparative Example 1 had a single phase of β-Mn. On the other hand, as illustrated in FIG. 5, it was confirmed that the magnetic material of Example 1, which was obtained after the nitriding treatment, had a structure that is separated into two phases. From the X-ray diffraction pattern result in (B) of FIG. 3, it is considered that the magnetic material of Example 1 has a structure that is separated into two phases including $Mn_4N$ and β-Mn. In the magnetic material of Example 1 illustrated in FIG. 5, a width of a different structure was 2 μm or less. As described above, it was confirmed that the structure inside the magnetic material of Example 1 was made fine.

As described above, from the results of FIG. 3 to FIG. 5, it was confirmed that when a phase mainly containing $Mn_4N$ precipitates, magnetization is exhibited in the magnetic material. In addition, when phase separation into a phase containing $Mn_4N$ and a phase containing β-Mn occurs, and a magnetic phase containing $Mn_4N$ is made fine, it is considered that magnetic properties such as the coercive force and the saturated magnetization are improved.

(Evaluation of Amount of Nitrogen in MnSn Magnetic Material and MnSnCo magnetic Material)

An amount of nitrogen in the magnetic material of Example 1 was evaluated. Results thereof are shown in Table 2.

TABLE 2

| Amount of Co (c value) | 0 | 5 | 10 | 15 | 20 | 25 | 30 | 35 | 40 | 50 |
|---|---|---|---|---|---|---|---|---|---|---|
| Amount of N (at %) | 18.1 | 17.3 | 15.5 | 12.3 | 12.5 | 11.5 | 10.9 | 10.0 | 8.8 | 7.3 |

It was confirmed that an amount of nitrogen in a Co composition range ($0 \leq c \leq 35$) capable of improving the magnetic properties illustrated in Table 1 is 10 at % or greater, that is, $10 \leq d$ as illustrated in Table 2.

[Variation of Magnetic Properties and Structure in Accordance with Presence or Absence of Nitriding Treatment: MnSnFe Material]

Example 2

With Nitriding Treatment

A magnetic material was produced on the basis of the second production method. As a raw material of a main component of the magnetic material, an electrolytic metal Mn with a purity of 99.9% and in a chip shape was prepared, and the raw material was pulverized with a disc mill in an Ar atmosphere to obtain a Mn powder having an average particle size of approximately 300 μm. Next, the Mn powder that was obtained was subjected to a heat treatment in an N atmosphere at 500° C. or lower for 5 hours to synthesize $Mn_4N$. In addition, $Mn_4N$ that was obtained was finely pulverized with a ball mill to obtain a $Mn_4N$ powder having an average particle size of approximately 5.5 μm. On the other hand, a carbonyl Fe powder having an average grain size of 3 μm was subjected to a heat treatment in an ammonia atmosphere at 500° C. or lower for 4 hours to obtain a Fe4N powder. Next, weighing was performed with an electronic balance in such a manner that composition ratios of Mn, Sn, and Fe became $Mn_{70}Sn_{15}Fe_{15}$. Respective powders which were weighed were put into a ball mill, and were mixed and pulverized in a heptane solvent for 1 hour (mixing step). The resultant powder was suction-filtered and was sufficiently dried in the air. Then, the dried powder was pressed in a cylindrical mold having a diameter ϕ of 12 mm at a pressure of approximately $5 \times 10^7$ kg/m$^2$ to obtain a molded body (molding step). The molded body that was obtained was subjected to a heat treatment in a nitrogen atmosphere at 950° C. for 5 hours, and temperature-lowering was performed to 300° C. at a rate of 0.5° C./min, thereby sintering the pressed body (Heat treatment step). According to this, a magnetic material $(Mn_{70}Sn_{15}Fe_{15})_{100-d}N_d$ ($0<d$) was produced.

Comparative Example 2

Without Nitriding Treatment

Production was performed in the same manner as in Example 2 except that the process was stopped before performing the nitriding treatment (before the heat treatment step) in Example 2.

(Evaluation of Magnetic Properties of MnSnFe Magnetic Material)

Magnetic measurement of the magnetic material of Example 2 was performed to obtain a residual magnetization $B_r$, the coercive force $H_c$, and the saturated magnetization $J_s$. The magnetic properties were measured by using B-H tracer manufactured by TOEI INDUSTRY CO., LTD. As measurement conditions, the temperature was set to room temperature, and the maximum applied magnetic field was set to 2000 kA/m (25 kOe). Obtained results are illustrated in Table 3.

TABLE 3

| | Residual magnetization $B_r$ (mT) | Coercive force $H_c$ (kA/m) | Saturated magnetization $J_s$ (mT) |
|---|---|---|---|
| Before nitriding treatment (Comparative Example 2) | 17 | 28 | 24 |
| After nitriding treatment (Example 2) | 150 | 328 | 177 |

As illustrated in Table 3, in a sample after the nitriding treatment (Example 2), values of the saturated magnetization $J_s$ and the coercive force $H_c$ were further increased in comparison to the magnetic material before the nitriding treatment (Comparative Example 2). It was confirmed that values of the residual magnetization $B_r$, the coercive force $H_c$, and the saturated magnetization $J_s$ of the MnSnFe magnetic material after the nitridation are approximately the same as those of the MnSnCo magnetic material in Table 1, and any of these has a satisfactory magnetic property.

(Structure Evaluation of MnSnFe Magnetic Material).

A structure of Example 2 ($(Mn_{70}Sn_{15}Fe_{15})_{100-d}N_d$ ($0<d$)) and a structure of Comparative Example 2 ($Mn_{70}Sn_{15}Fe_{15}$) were evaluated. In the structure evaluation, an X-ray diffraction device and a scanning electron microscope are used. (A) of FIG. 6 is an X-ray diffraction pattern in the magnetic material before a nitriding treatment (Comparative Example 2). (B) of FIG. 6 is an X-ray diffraction pattern in the magnetic material after the nitriding treatment (Example 2).

As illustrated in (A) of FIG. 6, it was confirmed that the magnetic material ($Mn_{70}Sn_{15}Fe_{15}$) of Comparative Example 2 contains β-Mn. In addition, as illustrated in (B) of FIG. 6, it was confirmed that the magnetic material ($(Mn_{70}Sn_{15}Fe_{15})_{100-d}N_d$ ($0<d$)) of Example 2 contains $Mn_4N$ and β-Mn. As described above, it is confirmed that $Mn_4N$ that is ferrimagnetism was exhibited after the nitriding treatment.

FIG. 7 is a reflected electron image of the magnetic material of Comparative Example 2, and FIG. 8 is a reflected electron image of the magnetic material of Example 2. As illustrated in FIG. 7, it was confirmed that the magnetic material of Comparative Example 2 has an approximately single phase structure. From the X-ray diffraction pattern result in (A) of FIG. 6, it is considered that the magnetic material of Comparative Example 2 has a single phase of β-Mn. On the other hand, as illustrated in FIG. 8, it was confirmed that the magnetic material of Example 2, which was obtained after the nitriding treatment, had a structure that is separated into two phases. From the X-ray diffraction pattern result in (B) of FIG. 6, it is considered that the magnetic material of Example 2 has a structure that is separated into two phases of $Mn_4N$ and β-Mn. In addition, in the magnetic material of Example 2 which is illustrated in FIG. 8, a width of a different structure was 2 μm or less. As described above, it is confirmed that the structure inside the magnetic material of Example 2 is made fine.

As described above, from the results in FIG. 6 to FIG. 8, it was confirmed that when a phase mainly containing $Mn_4N$ precipitates, magnetization is exhibited in the magnetic material. In addition, when phase separation into a phase containing $Mn_4N$ and a phase containing β-Mn occurs, and a magnetic phase containing $Mn_4N$ is made fine, it is considered that magnetic properties such as the coercive force and the saturated magnetization are improved.

[Details of Magnetic Properties after Nitriding Treatment: MnSn Magnetic Material and MnSNFe Magnetic Material]

Example 3

A magnetic material was produced on the basis of the first production method. First, as raw materials of main components of the magnetic material, an electrolytic metal Mn with a purity of 99.9% and in a chip shape of 5 mm to 20 mm, an electrolytic Fe powder with a purity of 99.7% and in a block shape, and Sn with a purity of 99.8% and in a shot shape having a particle size of 2 mm to 4 mm were prepared. These raw materials were weighed with an electronic balance to realize a compositional formula: $Mn_aSn_bFe_c$ ($0 \leq a \leq 100$, $0 < b \leq 50$, $0 \leq c \leq 50$), and the respective raw materials which were weighed were subjected to arc melting to form an alloy (melting step). The alloy that was obtained was subjected to gas atomization by using an argon gas to obtain a powder (powdering step). The powder was sorted with a sieve to obtain a powder having an average particle size of approximately 100 μm, and the powder that was obtained was compression-molded with a cylindrical mold having a diameter ϕ of 12 mm at a pressure of approximately $5 \times 10^7$ kg/m$^2$ (molding step). The molded body that was obtained was subjected to a heat treatment in a mixed atmosphere containing 3 vol % of ammonia and 97 vol % of nitrogen for 5 hours, and temperature-lowering was performed to 300° C. at a rate of 0.5° C./min, thereby obtaining a sintered body (heat treatment step). A temperature during the heat treatment was changed in accordance with a difference in the amount of Sn. In a case where the amount of Sn was 5 at %, the temperature was set to 1120° C. In a case where the amount of Sn was 10 at %, the temperature was set to 1080° C. In a case where the amount of Sn was 20 at %, the temperature was set to 1000° C. In a case where the amount of Sn was 30 at %, the temperature was set to 980° C. In a case where the amount of Sn was 40 at %, the temperature was set to 930° C. In a case where the amount of Sn was 50 at %, the temperature was set to 900° C. According to this, a magnetic material ($(Mn_aSn_bFe_c)_{100-d}N_d$ ($a+b+c=100$, $0<d$)) was produced.

Comparative Example 3

Production was performed in the same manner as in Example 3 except that the amount of Sn in Example 3 was set to 0 at % ($b=0$), and the heat treatment temperature was set to 1150° C.

(Evaluation of Magnetic Properties of Magnetic Material)

Magnetic measurement of the magnetic materials of Example 3 and Comparative Example 3 was performed to obtain the coercive force $H_c$, and the saturated magnetization $J_s$. The magnetic properties were measured by using B-H tracer manufactured by TOEI INDUSTRY CO., LTD. As measurement conditions, the maximum applied magnetic field was set to 2000 kA/m (25 kOe). Obtained results are collectively illustrated in Table 4 to Table 6.

TABLE 4

| | Fe (at %) | | | | | | | | | |
|---|---|---|---|---|---|---|---|---|---|---|
| Sn (at %) | 0 | 5 | 10 | 15 | 20 | 25 | 30 | 35 | 40 | 50 |
| 0 | 40 | 42 | 35 | 41 | 45 | 30 | 32 | 32 | 21 | 36 |
| 3 | 56 | 63 | 58 | 85 | 100 | 75 | 54 | 65 | 35 | 45 |
| 5 | 160 | 167 | 185 | 202 | 164 | 175 | 163 | 160 | 120 | 85 |
| 10 | 350 | 358 | 405 | 340 | 236 | 220 | 196 | 195 | 156 | 75 |
| 15 | 403 | 430 | 442 | 308 | 260 | 238 | 205 | 201 | 140 | 68 |
| 20 | 420 | 360 | 298 | 307 | 236 | 220 | 196 | 189 | 153 | 85 |
| 25 | 382 | 321 | 285 | 265 | 240 | 241 | 230 | 212 | 183 | 105 |
| 30 | 365 | 360 | 298 | 307 | 236 | 220 | 196 | 201 | 170 | 131 |
| 35 | 278 | 270 | 258 | 204 | 199 | 186 | 179 | 166 | 158 | 142 |
| 40 | 165 | 168 | 170 | 156 | 146 | 135 | 142 | 143 | 155 | 102 |
| 50 | 142 | 130 | 157 | 120 | 105 | 65 | 58 | 67 | 75 | 50 |

Table 4 illustrates a value (kA/m) of the coercive force $H_c$ in each composition. As illustrated in Table 4, in the MnSn magnetic material ($c=0$), the coercive force $H_c$, as large as 160 kA/m (2 kOe) or greater was obtained in a range of 5 b 40. In addition, in the MnSnFe magnetic material ($(Mn_aSn_bFe_c)_{100-d}N_d$ ($a+b+c=100$, $0<d$)), the coercive force as large as 160 kA/m (2 kOe) or greater was obtained in a range of $30 \leq a \leq 95$, $5 \leq b \leq 35$, and $0<c \leq 35$. From these results, it was confirmed that the MnSn magnetic material and the MnSnFe magnetic material are high-coercive-force materials having the coercive force greater than that of the magnet which is alloy system of the related art.

TABLE 5

| | Fe (at %) | | | | | | | | | |
|---|---|---|---|---|---|---|---|---|---|---|
| Sn (at %) | 0 | 5 | 10 | 15 | 20 | 25 | 30 | 35 | 40 | 50 |
| 0 | 155 | 165 | 173 | 184 | 205 | 210 | 314 | 368 | 454 | 589 |
| 3 | 147 | 155 | 160 | 175 | 186 | 195 | 244 | 338 | 365 | 479 |
| 5 | 135 | 148 | 154 | 165 | 178 | 181 | 215 | 305 | 332 | 415 |
| 10 | 124 | 131 | 143 | 155 | 169 | 177 | 205 | 254 | 305 | 395 |
| 15 | 120 | 127 | 135 | 143 | 154 | 163 | 185 | 224 | 274 | 356 |
| 20 | 115 | 123 | 130 | 135 | 147 | 159 | 168 | 195 | 216 | 290 |
| 25 | 109 | 116 | 124 | 130 | 138 | 147 | 156 | 183 | 195 | 242 |
| 30 | 105 | 108 | 111 | 125 | 125 | 138 | 148 | 166 | 178 | 218 |
| 35 | 100 | 102 | 102 | 112 | 110 | 125 | 138 | 154 | 163 | 197 |
| 40 | 68 | 85 | 90 | 95 | 96 | 105 | 114 | 124 | 132 | 143 |
| 50 | 24 | 31 | 20 | 32 | 46 | 65 | 76 | 87 | 95 | 99 |

Table 5 illustrates a value (mT) of the saturated magnetization $J_s$ in each composition. As illustrated in Table 5, a saturated magnetization $J_s$ as large as 100 mT (1000 G) or greater was obtained in a range of $0 \leq b \leq 35$, and $0 \leq c \leq 50$. In addition, as illustrated in Table 5, as an amount of Fe increases, the saturated magnetization $J_s$ was improved. As described above, it was confirmed that it is effective to contain Fe so as to improve the saturated magnetization $J_s$. From Table 4 and Table 5, it became clear that both a high-coercive-force and a high saturated magnetization are obtained in a composition range satisfying relationships of $5 \leq b \leq 35$, and $0 \leq c \leq 35$.

TABLE 6

| Amount of Fe (c value) | 0 | 5 | 10 | 15 | 20 | 25 | 30 | 35 | 40 | 50 |
|---|---|---|---|---|---|---|---|---|---|---|
| Amount of N (at %) | 18.1 | 17.4 | 15.7 | 12.5 | 12.6 | 11.4 | 11.2 | 10.5 | 9.2 | 7.5 |

Table 6 illustrates an amount of nitrogen after nitridation in a composition ($Mn_{90-c}Fe_cSn_{10}$ ($0 \leq c \leq 50$)) in which an amount of Sn was set to 10 at % (b=10) and each Fe composition was set to c. It was confirmed that an amount of nitrogen in a range of $0 \leq c \leq 35$ that is a composition range, in which the coercive force illustrated in Table 5 was improved, was 10 at % or greater as illustrated in Table 6, that is, $10 \leq d$.

[Variation in Magnetic Properties due to Nitriding Treatment in Magnetic Field]

Example 4-1

Production was performed in the same manner as in Example 2 except that the temperature-lowering to 300° C. in the production method of Example 2 was performed in a static magnetic field of 1600 kA/m.

Example 4-2

Production was performed in the same manner as Example 2.

(Evaluation of Magnetic Properties of Magnetic Material)

Magnetic measurement of the magnetic materials of Example 4-1 and Example 4-2 was performed to obtain the residual magnetization $B_r$, the coercive force $H_c$, and the saturated magnetization $J_s$. The magnetic properties were measured by using B-H tracer manufactured by TOEI INDUSTRY CO., LTD. As measurement conditions, the maximum applied magnetic field was set to 2000 kA/m (25 kOe). Obtained results are illustrated in Table 7.

TABLE 7

| | Residual magnetization $B_r$ (mT) | Coercive force $H_c$ (kA/m) | Saturated magnetization $J_s$ (mT) |
|---|---|---|---|
| Nitriding treatment with no magnetic field (Example 4-2) | 150 | 328 | 177 |
| Nitriding treatment in a magnetic field (Example 4-1) | 185 | 360 | 200 |

As illustrated in Table 7, in the magnetic material (Example 4-1) which was subjected to the nitriding treatment in a magnetic field, the magnetic properties were further improved in comparison to the magnetic material (Example 4-2) which was subjected to the nitriding treatment with no magnetic field. From the result, it was confirmed that when a nitriding and heat treatment was performed in a magnetic field, it is possible to improve the magnetic properties.

[MnSnX Magnetic Material]

Example 5-1

A magnetic material was produced on the basis of the second production method. As a raw material of a main component of the magnetic material, an electrolytic metal Mn with a purity of 99.9% and in a chip shape was prepared, and the raw material was pulverized with a disc mill in an Ar atmosphere to obtain an Mn powder having an average particle size of approximately 300 μm. Next, fine pulverization was performed with a ball mill to obtain a powder having an average particle size of approximately 5.5 μm. Next, the Mn powder that was obtained, an Sn powder having an average particle size of 63 μm, and a powder of an element X (Cr, Nb, Ga, Cu, V, Ni, Zr, Ti, Zn, or Al) which has an average particle size of 75 μm or less were weighed with an electronic balance to realize an element ratio of $Mn_{80}Sn_{10}X_{10}$, and these powders were finely pulverized with a ball mill, and were mixed and pulverized in a heptane solution for 1 hour. Then, the resultant mixture was suction-filtered, and was sufficiently dried (mixing step). The dried mixture was pressed in a cylindrical mold having a diameter ϕ of 12 mm at a pressure of approximately $5\times10^7$ kg/m$^2$ to obtain a molded body (molding step). The molded body that was obtained was subjected to a heat treatment in a mixed atmosphere of ammonia and nitrogen at 1050° C. for 5 hours, and then temperature-lowering was performed to 300° C. at a rate of 0.5° C./min, thereby obtaining a sintered body (heat treatment step). According to this, a magnetic material ($(Mn_{80}Sn_{10}X_{10})_{100-d}N_d$ (0<d)) was produced.

Example 5-2

The magnetic material ($(Mn_{80}Sn_{10}Fe_{10})_{100-d}N_d$ (0<d)) in Example 3 was set as a magnetic material.

(Evaluation of Magnetic Properties of Magnetic Material)

Magnetic measurement of the magnetic materials of Example 5-1 and Example 5-2 was performed to obtain the coercive force $H_c$ and the saturated magnetization $J_s$. The magnetic properties were measured by using B-H tracer manufactured by TOEI INDUSTRY CO., LTD. As measurement conditions, the maximum applied magnetic field was set to 2000 kA/m (25 kOe). Obtained results are illustrated in Table 8.

TABLE 8

| | | Coercive force $H_c$ (kA/m) | Saturated magnetization $J_s$ (mT) |
|---|---|---|---|
| Example 5-2 | $(Mn_{80}Sn_{10}Fe_{10})_{100-d}N_d$ | 405 | 143 |
| Example 5-1 | $(Mn_{80}Sn_{10}Ni_{10})_{100-d}N_d$ | 195 | 212 |
| | $(Mn_{80}Sn_{10}Ti_{10})_{100-d}N_d$ | 603 | 112 |
| | $(Mn_{80}Sn_{10}Cu_{10})_{100-d}N_d$ | 162 | 147 |
| | $(Mn_{80}Sn_{10}Nb_{10})_{100-d}N_d$ | 525 | 132 |
| | $(Mn_{80}Sn_{10}Cr_{10})_{100-d}N_d$ | 175 | 148 |
| | $(Mn_{80}Sn_{10}Al_{10})_{100-d}N_d$ | 291 | 115 |
| | $(Mn_{80}Sn_{10}Zn_{10})_{100-d}N_d$ | 174 | 121 |
| | $(Mn_{80}Sn_{10}V_{10})_{100-d}N_d$ | 293 | 154 |
| | $(Mn_{80}Sn_{10}Zr_{10})_{100-d}N_d$ | 492 | 127 |
| | $(Mn_{80}Sn_{10}Ga_{10})_{100-d}N_d$ | 564 | 105 |

From Example 5-1 in Table 8, it could be seen that in a case where the element X was Cr, Nb, Ga, Cu, V, Ni, Zr, Ti, Zn, or Al, the coercive force $H_c$ exhibited a value of 160 kA/m (2kOe) or greater, and the saturated magnetization $J_s$ exhibited a value of 100 mT (1000 G) or greater. In addition, when comparing Example 5-1 and Example 5-2 with each other, it was confirmed that when the element X was Ni, V, Cr, or Cu, there is approximately the same magnetization improving effect as in a case where the element X was Fe. In addition, as the element X, when Ti, Nb, Zr, or Ga was included in the raw material, it was confirmed that there is the coercive force improving effect greater than that in a case where the element X was Fe.

[Variation in Magnetic Properties of Magnetic Material in Case where Other Elements are Added to MnSnFe Magnetic Material]

Example 6-1

A magnetic material was produced on the basis of the second production method. First, as a raw material of a main component of the magnetic material, an electrolytic metal Mn with a purity of 99.9% and in a chip shape was prepared, and the raw material was pulverized with a disc mill in an Ar atmosphere to obtain an Mn powder having an average particle size of approximately 300 μm. Next, fine pulverization was performed with a ball mill to obtain a powder having an average particle size of approximately 5.5 μm. Next, the Mn powder that was obtained, a carbonyl Fe powder having an average particle size of 3 μm, an Sn powder having an average particle size of 63 μm, and a powder of an element X (Cr, Nb, Ga, Cu, V, Ni, or Al) which has an average particle size of 75 μm or less were weighed with an electronic balance to realize an element ratio of $Mn_{70}Sn_{10}Fe_{10}X_{10}$. These powders were finely pulverized with a ball mill, and were mixed and pulverized in a heptane solution for 1 hour. Then, the resultant mixture was suction-filtered, and was sufficiently dried (mixing step). The dried mixture was pressed in a cylindrical mold having a diameter ϕ of 12 mm at a pressure of approximately $5\times10^7$ kg/m$^2$ to obtain a molded body (molding step). The molded body that was obtained was subjected to a heat treatment in a mixed atmosphere of ammonia and nitrogen at 1050° C. for 5 hours, and then temperature-lowering was performed to 300° C. at a rate of 0.5° C./min, thereby obtaining a sintered body (heat treatment step). According to this, a magnetic material ($(Mn_{70}Sn_{10}Fe_{10}X_{10})_{100-d}N_d$ (0<d)) was produced.

Example 6-2

The magnetic material ($(Mn_{80}Sn_{10}Fe_{10})_{100-d}N_d$ (0<d)) in Example 3 was set as a magnetic material.

(Evaluation of Magnetic Properties of Magnetic Material)

Magnetic measurement of the magnetic materials of Example 6-1 and Example 6-2 was performed to obtain the residual magnetization $B_r$, the coercive force $H_c$, and the saturated magnetization $J_s$. The magnetic properties were measured by using B-H tracer manufactured by TOEI INDUSTRY CO., LTD. As measurement conditions, the maximum applied magnetic field was set to 2000 kA/m (25 kOe). Obtained results are illustrated in Table 9.

TABLE 9

| | | Residual magnetization $B_r$ (mT) | Coercive force $H_c$ (kA/m) | Saturated magnetization $J_s$ (mT) |
|---|---|---|---|---|
| Example 6-2 | $(Mn_{80}Sn_{10}Fe_{10})_{100-d}N_d$ | 122 | 405 | 143 |
| Example 6-1 | $(Mn_{70}Sn_{10}Fe_{10}Cr_{10})_{100-d}N_d$ | 150 | 245 | 174 |
| | $(Mn_{70}Sn_{10}Fe_{10}Nb_{10})_{100-d}N_d$ | 118 | 445 | 144 |
| | $(Mn_{70}Sn_{10}Fe_{10}Ga_{10})_{100-d}N_d$ | 133 | 532 | 117 |
| | $(Mn_{70}Sn_{10}Fe_{10}Cu_{10})_{100-d}N_d$ | 184 | 197 | 158 |
| | $(Mn_{70}Sn_{10}Fe_{10}V_{10})_{100-d}N_d$ | 163 | 241 | 179 |
| | $(Mn_{70}Sn_{10}Fe_{10}Ni_{10})_{100-d}N_d$ | 221 | 210 | 264 |
| | $(Mn_{70}Sn_{10}Fe_{10}Al_{10})_{100-d}N_d$ | 130 | 304 | 171 |
| | $(Mn_{70}Sn_{10}Fe_{10}Zr_{10})_{100-d}N_d$ | 125 | 483 | 142 |
| | $(Mn_{70}Sn_{10}Fe_{10}Ti_{10})_{100-d}N_d$ | 110 | 624 | 155 |
| | $(Mn_{70}Sn_{10}Fe_{10}Zn_{10})_{100-d}N_d$ | 128 | 404 | 151 |

From Table 9, it could be seen that in all combinations of Fe, and Cr, Nb, Ga, Cu, V, Ni, Zr, Ti, Zn, or Al in Example 6-1, the saturated magnetization was 100 mT (1000 G) or greater, and the coercive force was 160 kA/m (2 kOe) or greater. That is, it was confirmed that even when the element X is constituted by two or more elements, excellent magnetic properties are obtained. In addition, it was confirmed that when Cr, Cu, Ni, or V is combined with Fe, there is an effect of greatly increasing the saturated magnetization in comparison to Example 6-2 (only Fe). In addition, it was confirmed that when Ga, Nb, Zr, or Ti is combined with Fe, there is an effect of greatly increasing the coercive force in comparison to Example 6-2 (only Fe). As described above, it was confirmed that when selecting an element to be combined with Fe, it is possible to control an improvement in the magnetic properties to a certain extent. Accordingly, it was confirmed that when the above-described elements are approximately combined, it is possible to obtain a magnetic material having the magnetic properties such as desired coercive force and saturated magnetization.

INDUSTRIAL APPLICABILITY

The magnetic materials have the following industrial applicability. For example, it is possible to use the magnetic materials in the field of a permanent magnet, a magnetic recording medium, spintronics, and the like. In addition, the magnetic materials can be used as an equipment part or an element in which a high-coercive-force is demanded.

REFERENCE SIGNS LIST

1 PEROVSKITE STRUCTURE

The invention claimed is:

1. A magnetic material, wherein an internal structure is phase-separated into at least a first phase and a second phase, at least one of the first phase and the second phase includes a compound having a perovskite structure, the first phase and the second phase include Mn, Sn, and N, the magnetic material is expressed by a compositional formula $(Mn_aSn_bX_c)_{100-d}N_d$ in which a+b+c=100, 30≤a≤90, 5≤b≤35, 0≤c≤35, and 10≤d, and the element X is at least one kind of selected from the group consisting of Co, Fe, Cr, Nb, Ga, Cu, V, Ni, Zr, Ti, Zn, and Al.

2. The magnetic material according to claim 1, wherein the first phase includes at least $Mn_4N$ or $Mn_3SnN$.

3. The magnetic material according to claim 1, wherein the second phase includes at least β-Mn or α-Mn.

4. A method for producing the magnetic material according to claim 1, the method comprising:

a melting step of melting metallic constituent elements except for nitrogen to form an alloy;

a powdering step of atomizing the alloy which is obtained in the melting step; and a heat treatment step of subjecting a powder, which is obtained in the powdering step, to a heat treatment in an atmosphere in which a nitrogen source is contained.

5. The method for producing the magnetic material according to claim 4, further comprising:

a molding step of compression-molding the powder that is obtained in the powdering step, wherein in the heat treatment step, a molded body, which is obtained in the molding step, is subjected to the heat treatment in the atmosphere in which the nitrogen source is contained.

6. The method for producing the magnetic material according to claim 4, wherein in the heat treatment step, the heat treatment is performed in a magnetic field.

7. A method for producing the magnetic material according to claim 1, the method comprising:

a mixing step of mixing a nitride powder or a metal powder which includes an element that constitutes the magnetic material;

a molding step of compression-molding a powder that is mixed in the mixing step; and a heat treatment step of subjecting a molded body, which is molded in the molding step, to a heat treatment in an atmosphere in which a nitrogen source is contained.

8. The method for producing the magnetic material according to claim 7, wherein the heat treatment step, the heat treatment is performed in a magnetic field.

* * * * *